United States Patent [19]

Thorbjörnsson

[11] Patent Number: 4,662,032

[45] Date of Patent: May 5, 1987

[54] METHOD AND APPARATUS FOR FORMING A WEB

[75] Inventor: Sven-Ingvar Thorbjörnsson, Karlstad, Sweden

[73] Assignee: KMW Aktiebolag, Karlstad, Sweden

[21] Appl. No.: 860,183

[22] Filed: May 6, 1986

[30] Foreign Application Priority Data

May 8, 1985 [SE] Sweden ..... 8502259

[51] Int. Cl.[4] ..... D04H 1/00; D01G 25/00

[52] U.S. Cl. ..... 19/300; 19/304

[58] Field of Search ..... 19/300, 304

[56] References Cited

U.S. PATENT DOCUMENTS

| | | | |
|---|---|---|---|
| 2,715,755 | 8/1955 | Jones | 19/304 X |
| 2,940,135 | 6/1960 | Heritage | 19/304 X |
| 3,032,836 | 5/1962 | Anderberg et al. | 19/300 |
| 3,071,822 | 1/1963 | Meiler | 19/302 X |
| 3,744,092 | 7/1973 | Auten | 19/300 |
| 3,792,943 | 2/1974 | Helgesson | 19/300 X |
| 4,099,296 | 7/1978 | Gustavsson | 19/304 |

*Primary Examiner*—Louis K. Rimrodt

*Attorney, Agent, or Firm*—Bell, Seltzer, Park & Gibson

[57] ABSTRACT

A method and apparatus for forming a web having a predetermined grammage profile in its transverse direction is provided. The method includes the steps of introducing a composite flow of particulate material suspended in air into the distribution chamber of a forming head and depositing the material on the upper surface of an air permeable belt while applying suction to form a web and while the grammage profile is controlled by measuring the profile of the web downstream of the distribution chamber, comparing the measurement with predetermined set points, generating a control signal representative of any detected difference and controlling the amount of suction applied in predetermined suction sections in response to the control signal so as to provide a web having a predetermined grammage profile. An apparatus for accomplishing each of the steps of the method is also provided.

7 Claims, 3 Drawing Figures

METHOD AND APPARATUS FOR FORMING A WEB

BACKGROUND OF THE INVENTION

The present invention relates to a method and apparatus for forming a web having a predetermined grammage profile in its transverse direction.

When forming a web of particulate material such as wood or synthetic fibers, it is known to use air to transport the particles in a forming head to an airpermeable wire on which the particulate material is collected and forms a web while the air passes through the web and the wire and is drawn off via a suction box by means of a slight subatmospheric pressure generated by a fan system. The wire is driven forward at a controlled speed so that a web having a certain weight per unit area is formed. In order to reduce variations in the grammage (i.e. weight per unit area) which may occur during forming, at least in the manufacture of thicker webs, a scalper roll is used which cuts excess material from the upper side of the web. The position of the scalper roll in relation to the wire can be controlled by measuring equipment located after the roll for measuring grammage. This equipment may comprise a weighing plate or some other type of grammage meter. This procedure enables a web to be produced with uniform grammage in its longitudinal direction.

Substantially uniform grammage is also desired in the transverse direction of the web. In certain cases it is even desirable to be able to vary the grammage across the web, the edge portions of the web having greater grammage than the central portion, for instance, since experience has shown that a certain squeeze effect will occur at the edge portions of the web during subsequent treatment of the web. In the manufacture of fiberboard, for instance, air is squeezed out from the edge portions of the subsequent belt pre-compression and hot compression steps. If the web has been formed with suitably increased grammage in the edge portions, the final result will then be that the finally pressed board will be substantially uniform in grammage and density transverse to the direction of forming, which is important if it is to be acceptably strong at the edge portions. A web with initially uniform grammage in its cross direction, though, will have lower grammage and density at the edge portions in the final board. The edge portions of the board will therefore have low strength properties. The properties of the edge portions will determine if the product is to be classed as first or second quality. Therefore, the choice is between increasing the average grammage in order to obtain acceptable properties in the edge portions, or sawing off the unacceptable part of the edge portions. Both alternatives result in extra material consumption and increased manufacturing costs.

To control the grammage across the web, it is known when using air carried fibers to give the fiber flow entering the distribution chamber of the forming head an oscillating movement transverse to the direction of movement of the web. This oscillation can be achieved either mechanically as is described in U.S. Pat. No. 3,071,822 or pneumatically as described in U.S. Pat. No. 4,099,296 (substantially corresponding to SE No. 7510795-3).

The distribution of fibers across the web in apparatuses using pneumatically controlled fiber distribution has not been satisfactory in that it has been necessary in practice to apply rolls or loaded sliding shoes to press down the edge portions of the fiber web in an attempt to achieve increased grammage at the edge portions. The use of rolls or sliding shoes has considerable drawbacks. For one thing, the load distribution must be varied for varying grammage in order to achieve an acceptable result; and for another, there is a considerable risk that the upper surface of the fiber web will be rolled up, roughened or otherwise destroyed. Apparatuses using mechanically controlled fiber distribution such as the apparatus described in the aforementioned patent do not succeed in achieving the desired grammage profile across the web and there, too, it has been necessary in practice to use rolls or sliding shoes similar to those described above, in order to improve the result.

In other applications it has been necessary to camber the scalper roll to a certain extent in order to at least improve the grammage profile across the width of the web. This has the obvious drawback that the desired grammage profile across the width of the web can only be obtained at nominal grammage.

The object of the invention is to minimize the problems mentioned above and to provide a method and an apparatus for forming a web in such a manner and using such means that a predetermined grammage profile can be continuously obtained, so that desired variations in grammage across the web can be controlled and adjusted automatically in a reliable manner.

SUMMARY OF THE INVENTION

The invention relates to a method of forming a web having a predetermined grammage profile in its transverse direction, comprising the steps of introducing a composite flow of particulate material suspended in air to the distribution chamber of a forming head, depositing the material onto the upper surface of an air permeable belt moving through the distribution chamber to form a web, applying suction from the underside of the belt through a plurality of suction sections positioned in substantially parallel relation to one another and to the longitudinal direction of the belt, and automatically controlling the grammage profile by measuring the profile of the web downstream of the distribution chamber, comparing the measurements of the profile with predetermined set points, generating a control signal indicative of any difference between the profile measurements and the set points and controlling the amount of suction applied in predetermined suction sections in response to the control signal to obtain said predetermined grammage profile.

According to a preferred embodiment of the invention the control signal is used to control the subatmospheric pressure in at least the two outermost suction sections or in several suction sections at the two edge portions of the web. The subatmospheric pressure or suction may be controlled either at the suction sections of a suction box arranged below the distribution chamber in the forming head so that the airflow and thus the amount of particulate material precipitated on the belt increases or decreases depending on the value of the signal or in the suction sections of a suction box located downstream of the forming head and below the belt, so that the airflow and thus the degree of compression of the web within the area for said controlled suction sections increases or decreases depending on the value of the control signal. According to another preferred embodiment, the subatmospheric pressure at the suction sections is controlled in both these suction boxes.

The invention also relates to an apparatus for forming a web having a predetermined grammage profile in its transverse direction, said apparatus comprising a forming head with a distribution chamber, means for introducing a composite flow of particulate material suspended in air into the distribution chamber, a horizontal air permeable belt mounted for movement through the distribution chamber and for receiving the material on the upper surface of the belt to form the web, suction means positioned on the underside of the belt and comprising a plurality of suction sections positioned in substantially parallel relation to one another and to the longitudinal direction of the belt, web sensor means positioned downstream of the distribution chamber for measuring the profile of the web, means for comparing the measurements of the profile with predetermined set points and for generating control signals resulting from the comparison, and suction control means responsive to the control signals for adjusting the suction applied in predetermined suction sections aligned with those sections across the web within which the grammage is to be altered in order to obtain said predetermined grammage profile across the web.

DESCRIPTION OF THE DRAWINGS

The invention will be described further in the following detailed description with reference to the accompanying drawings in which.

DETAILED DESCRIPTION OF THE PREFERRED EMBODIMENTS

Figure 1:
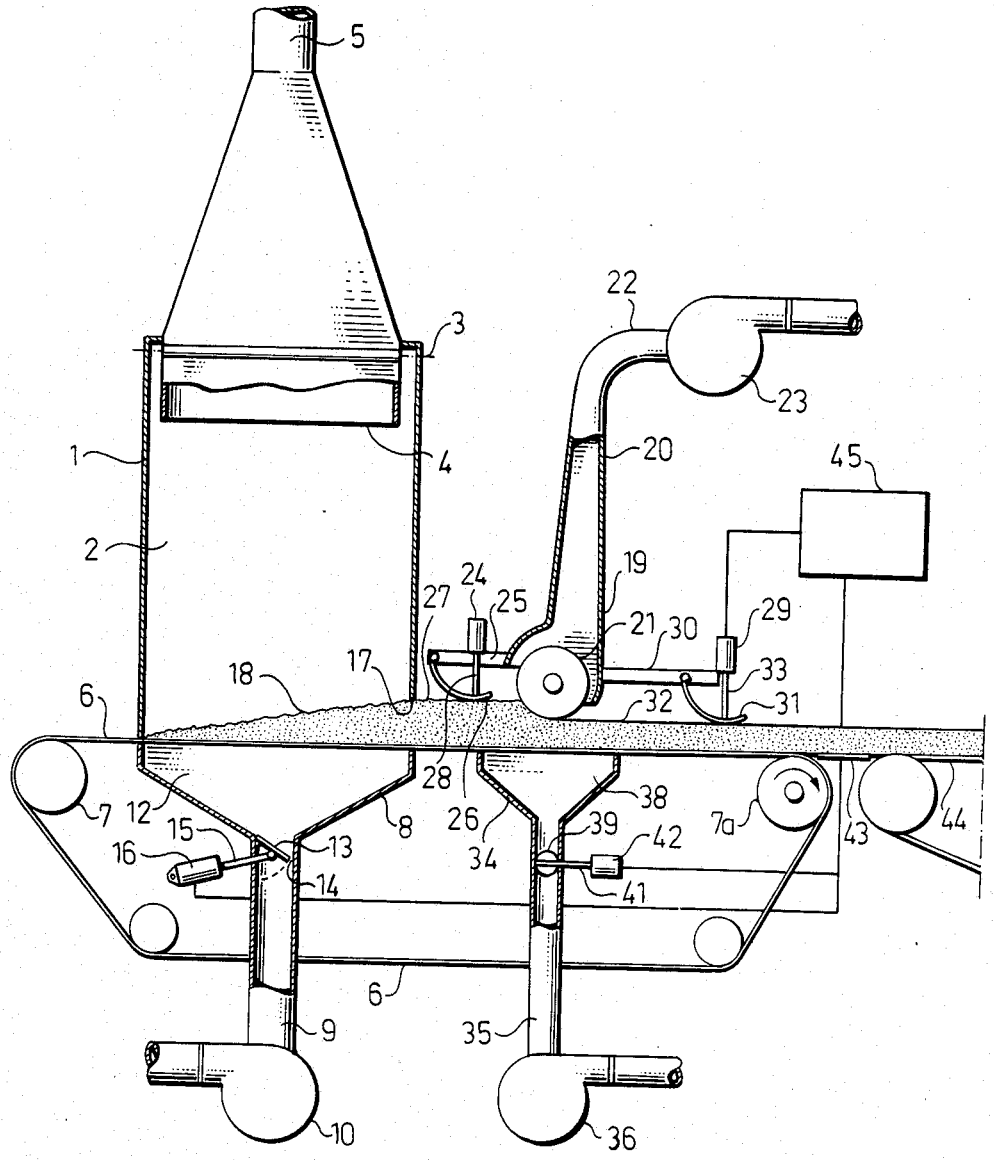
FIG. 1 is a side view schematic of an apparatus for forming a web according to a preferred embodiment of the invention.

With reference to FIG. 1 is it schematically shown therein parts of an apparatus for forming a web of a particulate material such as wood or synthetic fibers, said apparatus comprising a forming head 1 with a distribution chamber 2 and a nozzle 4 oscillating about a shaft 3 and with its orifice positioned in the upper part of the distribution chamber 2 and communicating with a container (not shown) via a supply pipe 5 for supplying the particulate material in a carrier air stream.

An air permeable belt or wire 6 runs in a loop around a plurality of rollers 7, the roll 7*a* being the driving one. The wire 6 is arranged to run horizontally through the distribution chamber 2, with its surface exposed in order to continuously receive particles flowing down through the distribution chamber 2.

The forming head 1 also includes a suction means in the form of a suction box 8 located below the wire 6 and the distribution chamber 2, with which the suction box is aligned. The suction box 8 has an outlet 9 with fan 10 arranged to generate a suitable subatmospheric pressure in the suction box 8 and to remove the carrier air drawn into the suction box from the distribution chamber 2 through the wire 6.

Figure 2:
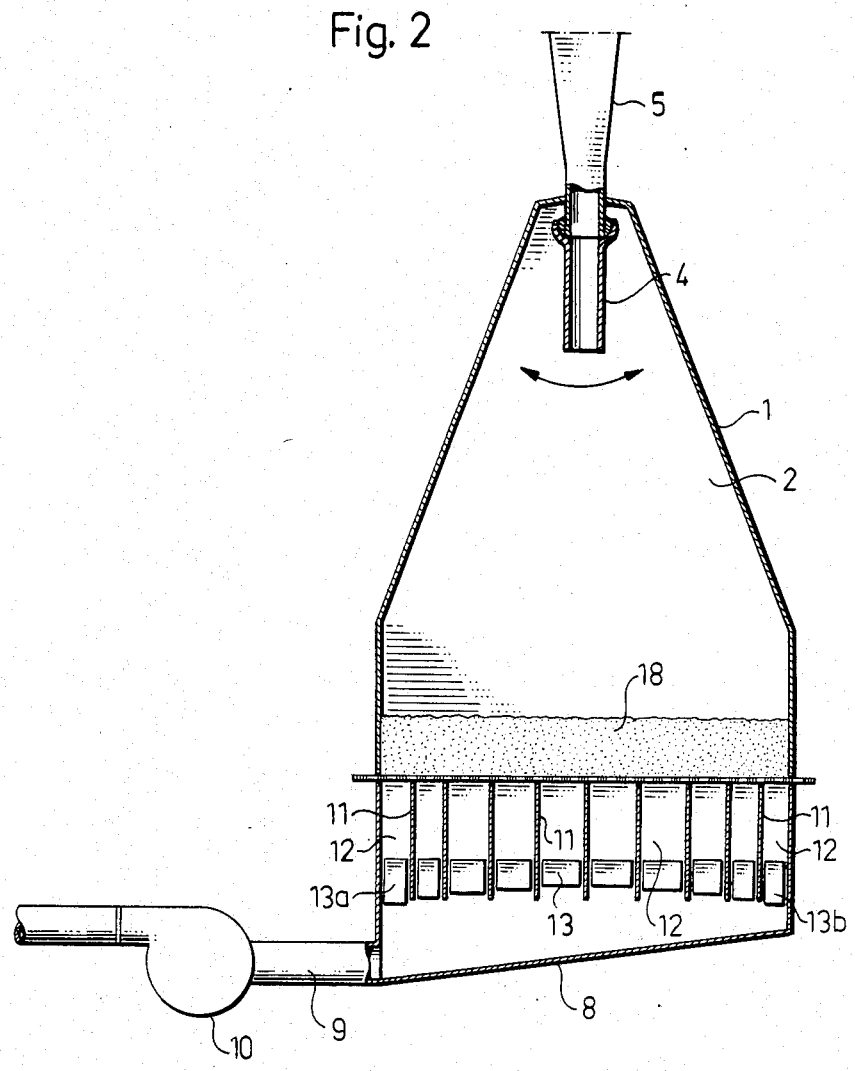
FIG. 2 shows a vertical cross section through the apparatus according to FIG. 1.

As will be seen more clearly in FIG. 2, the suction box 8 is provided with a plurality of vertical partitions 11 mounted parallel to the longitudinal direction of the wire and dividing the suction box 8 into a plurality of separate, adjacent suction sections 12. Each suction section 12 is provided in its lower area with a throttle 13 to enable adjustment of a suction gap 14 between section 12 and outlet 9. In the embodiment shown, each of the throttles 13*a* and 13*b* belonging to the two outermost suction sections is connected to a setting device in the form of a hydraulic cylinder 16, whose piston rod 15 actuates the throttle 13*a* or 13*b*, respectively, to adjust the suction gap 14 to the desired size, thus altering the subatmospheric pressure in the two outermost suction sections 12 in relation to that in the other sections. Alternatively the throttles may be set by a common setting device. In another alternative embodiment (not shown) a group of two or more of the suction sections close to the two longitudinal sides of the suction box, i.e. at the two edge portions of the web, are controlled in this way, either individually, or by a common hydraulic cylinder. The setting devices may be pneumatic cylinders, step motors or motor-driven screw-and-nut devices.

As will be seen in FIG. 1, the distribution chamber 2 has a horizontal outlet 17 in connection to the wire 6 through which the wire 6 and a web 18 of particulate material formed thereon pass.

The apparatus shown in FIG. 1 is also provided with an adjustment means 19 located downstream of the forming head 1 and comprising a hood 20 fitted above the wire with a horizontal rotating scalper roll 21, arranged at a predetermined distance from the wire 6 in order to cut excess material from the web 18 passing beneath the scalper roll 21. The hood 20, forming a vertically movable unit with the scalper roll 21, communicates by way of a sliding connection with an upper outlet 22 in which a fan 23 is arranged to suck off the excess material removed by scalper roll 21. Between the forming head 1 and the adjustment means 19 are web sensor means depicted as three sensors 24 for level measurements, distributed across the width of the web 18 and secured to the hood 20 by support arms 25. Each sensor 24 is provided with a pivotable element 26 arranged to lie in contact with the web 18 to sense the level of the upper surface 27 in relation to a reference plane, and thus react to any changes in this level. These changes are recorded in a suitable manner via a connecting arm 28. Vertical movement of the hood 20 up or down results in a change in reference plane in relation to the wire plane. Said recorded levels thus form the thickness profile of the web 18 prior to the scalper roll 21. Signals from all three sensors 24 are processed and the average value is compared with a set point for desired thickness of the web 18. When differences are recorded, control signals are generated which actuate the discharge of particulate material supplied from a store (not shown), the amount of particles supplied to the distribution chamber increasing or decreasing depending on the value of the control signal, until the desired thickness is deposited on the web 18. These sensors can also be used to provide information as to the thickness at the edge portions of the web 18 in relation to each other or in relation to the thickness in the central portion, recorded differences being compared with set points to generate control signals to actuate the operating means (not shown) which causes the nozzle 4 to oscillate, thus altering the distribution of the particulate material in the distribution chamber.

Web sensor means depicted as three sensors 29 for level measurements are also preferably arranged after the adjustments means 19 for adjusting the surface. The sensors 29 are distributed across the web in the same way as the sensors 24 described above. The sensors 29 are rigidly mounted by means of support arms 30 to the hood 20. As above, each sensor 29 has a pivotable element 31 sensing the level of the top surface 32 obtained by means of the scalper roll 21, in relation to a reference plane and which react to alterations in this level. These alterations are recorded in suitable manner via a connecting arm 33. Upon vertical movement on the hood 20 up or down, the position of the reference plane is altered in relation to the wire plane. Instead of being mounted on the hood 20, one or both groups of sensors 24 and 29 may be arranged on a stand of the apparatus which does not follow the movements of the hood 20.

Figure 3:
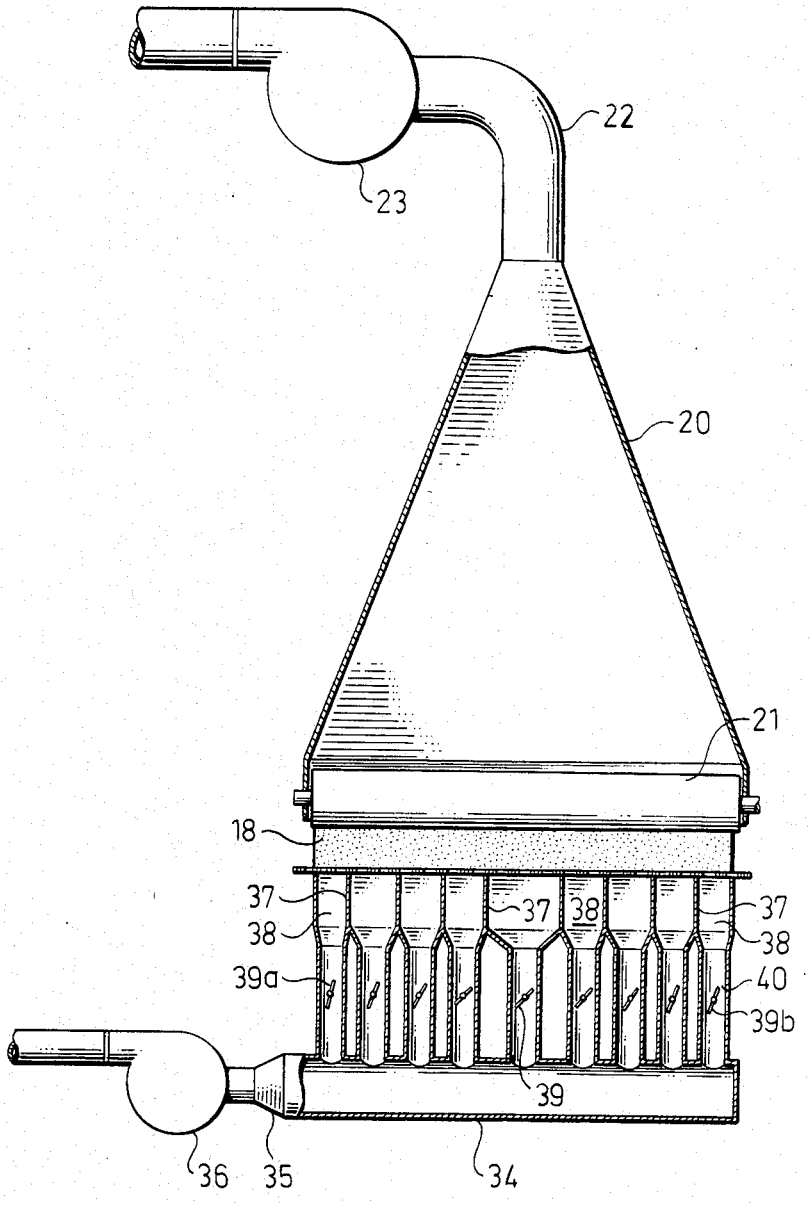
FIG. 3 shows a vertical cross section through an adjustment means provided in the apparatus according to FIG. 1.

In the embodiment shown, suction means in the form of a suction box 34 is also arranged below the wire 6 in connection to the adjustment means 19. The suction box 34 is provided with an outlet 35 having a fan 36 designed to generate a suitable subatmospheric pressure in the suction box 34 to draw air through the web 18 and wire 6. As with the suction box 8 described above, this section suction box 34 is also provided with a plurality of vertical partitions 37, as seen more clearly in FIG. 3. The partitions 37 are parallel to the longitudinal direction of the wire 6 and divide the suction box 34 into a plurality of separate suction sections 38, each provided in its lower part with a throttle 39 to set a suction gap 40 between the suction section 38 and outlet 35. In the embodiment shown, each throttle **39*a* and 39*b* of the two outermost suction sections is connected to a setting device in the form of a motor 42, whose shaft 41 influences the throttle 39*a* and 39*b*, respectively, to set the suction gap 40 at the desired size, thus altering the subatmospheric pressure in the two outer suction sections 38** in relation to that in the other sections. Alternatively, the throttles may be set by a common setting device. In another embodiment (not shown) a group of two or more of the suction sections close to the two longitudinal sides of the suction box, i.e. at the two edge portions of the web, are controlled in this way by a common motor or each by its own motor. The setting devices may also comprise hydraulic cylinders, pneumatic cylinders, or motor-driven screw-and-nut devices.

A separate sensor for measuring the grammage of the web 18 is also arranged at a suitable position after the scalper roll 21. In the embodiment shown (FIG. 1) this consists of a weighing plate 43 arranged after the wire 6 and before a following endless conveyor belt 44, in order to support the web 18 while at the same time sensing its weight. The scalper roll is vertically movable and its height is adjusted by a setting device (not shown) in accordance with the control signals obtained from the information about grammage gained from the weighing plate 43 after comparison with a set point of the grammage.

Adjustment of the throttles 13 in the suction box 8 below the distribution chamber 2, enables the subatmospheric pressure in each suction section 12 of the box 8 to be controlled individually so that a desired suitable quantity of air passes through the web 18 within each suction section 12. The quantity of air flowing through the wire depends on the thickness of the web 18 being continuously formed on the wire in the distribution chamber 2 and on the magnitude of the subatmospheric pressure prevailing in each suction section 12. Since the thickness of the web 18 transverse to its direction of movement is substantially constant the carrier air in the distribution chamber 2 can be guided to various suction sections depending on the subatmospheric pressure set for each section by the relevant throttle. The carrier or transport air can also be guided to suitable suction sections by swinging the nozzle 4 to and fro. Since the particles are carried to the wire 6 by the carrier air, by adjusting the throttles 13 and thus the subatmospheric pressure in suction sections 12, the particles can be guided to suitable areas across the direction of movement of the wire 6 to give a different grammage within this area to the grammage in an adjacent area. In this way the edge portions of the web 18 may be given greater grammage than the central portion. The increased subatmospheric pressure necessary to effect such increased flow of material to the edge portion or other areas, also causes the particles to be packed tighter together in the web 18. Higher density of the web 18 is thus achieved within these areas. Due to the elasticity of the particles, the web 18 will expand to a certain extent upon leaving the distribution chamber and this expansion will be greater where most particles have collected, thus somewhat decreasing the higher density achieved. It is therefore advantageous to subject the web 18 to additional subatmospheric pressure before the final cross-sectional profile is determined by the scalper roller 21 in order to control and further influence the grammage profile of the web 18 transverse to its longitudinal direction.

Since, as mentioned earlier, the web 18 acquires higher density upon increased subatmospheric pressure, by adjusting the subatmospheric pressure in the various suction sections 38 of the suction box 34 the grammage profile produced in the distribution chamber 2 can be retained. The effect can even be reinforced by greatly increasing the subatmospheric pressure in the sections of the suction box 34 in relation to that used in suction box 8. It is suitable to have the sensors located in the area of the suction action of the suction box 38.

The above valuable adjustment of the subatmospheric pressure in various sections is achieved through the present invention by the grammage of the web being controlled fully automatically by means of a feedback control system. In the embodiment shown the control system comprises said sensors 29 which record the levels of the web at the measuring points above the wire. The levels thus indicate the thickness profile of the web after the scalper roller 21. The control system includes means for comparing the measurements in the form of a regulator 45 which receives measured value signals from the sensors 29 and compares these with set point signals. When there are differences, control signals are generated which are permitted to actuate suction control means in the control system, which in the embodiment shown comprise setting devices as described above in the form of hydraulic cylinders 16 and motors 42 and regulation values in the form of throttles including **13*a*, 13*b*, 39*a*, 39*b***.

To maintain greater grammage at the edge portions the subatmospheric pressure in the outermost suction sections is adjusted by the signal from the middle sensor 29 being subtracted from the average value for the signals from the left and right sensors 29. The resultant measured value signal is then compared with a set point signal. In the event of a difference, a control signal is generated which is permitted to actuate said respective suction control means, changing the subatmospheric pressure until the difference signal becomes zero.

When the information from sensors 29 is used as output data to automatically control the grammage profile as described, certain assumptions must be made—depending on the number of sensors which should not be less than three—as to the relation between the thicknesses at these measuring points and the grammage corresponding thereto which is pre-programmed into the control system. In this case the system includes a control and calculating unit such as a micro-processor or PC equipment of known type.

Instead of sensors 29 for level measurements, a grammage meter of a type other than a weighing plate may be located downstream and used for automatic control of the grammage profile. This offers more detailed information as to the grammage distribution across the web. This type of sensor for grammage measurements is usually placed downstream of a pre-press described in the introduction, if such is used, whereupon some of the expected squeezing out takes place in the pre-press. This also has the advantage that the measured value will be closer to the final result for controlling the process. In this case also, a control and calculating unit similar to the one mentioned above is used.

In designing the suction system for the scalper roll it is important to screen off the edges of the web to prevent air from being drawn in from the side. Otherwise the edge portions of the web, which are the most important areas to be controlled, will not be compressed as intended since a reduced quantity of air will pass vertically through the entire thickness of the web. Such screening can be achieved with the aid of means (not shown) in the form of metal sheets secured to the permanent lower stand part and to the hood so that they slide close together as the scalper roll moves up and down. Alternatively an airtight cloth or the like, like a roller blind, may be arranged at each edge of the web. This may be attached to the hood at the top and to the permanent lower stand part at the bottom. The cloth will then automatically be rolled or unrolled onto the curtain rod as the scalper roll moves vertically.

In the drawings and specification there has been set forth a preferred embodiment of the invention, and although specific terms are employed, they are used in a generic and descriptive sense only and not for purposes of limitation.

That which is claimed is:

1. A method of forming a web having a predetermined grammage profile in its transverse direction comprising the steps of introducing a composite flow of particulate material suspended in air into the distribution chamber of a forming head, depositing said particulate material onto the upper surface of a horizontal air permeable belt moving through said distribution chamber to form a web, applying suction from the underside of said belt through a plurality of suction sections positioned below the distribution chamber of the forming head and oriented in substantially parallel relation to one another and to the longitudinal direction of said belt, also applying suction through a plurality of suction sections positioned downstream of said forming head, measuring the profile of the web downstream of said distribution chamber, comparing the measurements of the profile with predetermined set points, generating a control signal indicative of any difference between said profile measurements and said predetermined set points, and controlling the amount of suction applied in predetermined suction sections, including the amount of suction applied at the longitudinal edge portions of the web, in response to said control signal so as to correct deviations from the predetermined grammage profile across the web and to form a web having a higher grammage at said longitudinal edge portions than the grammage in the central region of the web.

2. An apparatus for forming a web having a predetermined grammage profile in its transverse direction comprising a forming head including a distribution chamber, means for introducing a composite flow of particulate material suspended in air into a distribution chamber, a horizontal air permeable belt mounted for movement through said distribution chamber and for receiving the particulate material on the upper surface of said belt so as to form a web, suction means positioned on the underside of said belt at a plurality of spaced-apart locations along the path of travel of said belt and comprising a plurality of suction sections positioned in substantially parallel relation to adjacent suction sections and to the longitudinal direction of said belt for applying suction from the underside of said belt, web sensor means positioned downstream of said distribution chamber for measuring the profile of the web, means for comparing the measurements of the profile of the web with predetermined set points and for generating control signals resulting from said comparison, and suction control means responsive to said control signals for adjusting the suction applied in predetermined suction sections including the amount of suction applied at the longitudinal edge portions of the web so as to obtain a predetermined grammage profile across the web.

3. An apparatus according to claim 2 wherein said suction means comprises a first suction box positioned below said distribution chamber, a second suction box positioned downstream from said forming head, and a plurality of longitudinal partitions dividing each of said suction boxes into a plurality of suction sections and wherein said suction control means is operable for adjusting the suction applied in predetermined suction sections within said suction boxes in accordance with the magnitude of said control signals.

4. An apparatus according to claim 3 further comprising a press station for compressing the formed web, and wherein said web sensor means is positioned downstream of said press station.

5. An apparatus according to claim 3 wherein said web sensor means includes means for measuring the grammage profile of said web.

6. An apparatus according to claim 3 further comprising vertically movable adjustment means positioned downstream from said forming head for removing excess material from the surface of said web and wherein said web sensor means are mounted on said adjustment means.

7. An apparatus according to claim 6 further comprising screen means cooperating with said adjustment means for screening the edges of the web and preventing air from being drawn in from outside.

* * * * *